US005460097A

United States Patent [19]

Nekola

[11] Patent Number: 5,460,097

[45] Date of Patent: Oct. 24, 1995

[54] HEATED AND INSULATED PRE-LUBRICATION DEVICE FOR AN ENGINE

[75] Inventor: Frank Nekola, Trenton, Fla.

[73] Assignee: Robert R. Pisano, Franklin Park, Ill.; part interest

[21] Appl. No.: 311,257

[22] Filed: Sep. 23, 1994

[51] Int. Cl.[6] ..... F01M 5/02

[52] U.S. Cl. ..... 123/196 S; 123/196 AB; 123/142.5 E; 184/6.3

[58] Field of Search ..... 123/196 S, 142.5 E, 123/196 AB, 41.14; 184/6.3, 6.4, 6.22, 104.2

[56] References Cited

U.S. PATENT DOCUMENTS

| | | | |
|---|---|---|---|
| 3,798,072 | 3/1974 | Anderson | 123/142.5 E |
| 4,940,114 | 7/1990 | Albrecht | 123/196 AB |
| 5,147,014 | 9/1992 | Pederson | 123/196 S |
| 5,159,910 | 11/1992 | Ninomiya et al. | 123/196 AB |
| 5,168,845 | 12/1992 | Peaker | 123/196 AB |
| 5,212,952 | 5/1993 | Yokoyama et al. | 60/721 |
| 5,220,892 | 6/1993 | Boemer | 123/196 AB |
| 5,310,020 | 5/1994 | Martin et al. | 184/6.3 |

FOREIGN PATENT DOCUMENTS

| | | | |
|---|---|---|---|
| 2728066 | 1/1979 | Germany | 123/196 AB |
| 0067036 | 6/1978 | Japan | 184/104.2 |

*Primary Examiner*—Henry C. Yuen
*Assistant Examiner*—Erick Solis
*Attorney, Agent, or Firm*—Saliwanchik & Saliwanchik

[57] ABSTRACT

An apparatus for preoiling an internal combustion engine prior to starting. This device requires no pump and is operated by vacuum and oil pressure from the engine. The apparatus is controlled by novel switching means and is recharged with hot engine oil that is drawn into a holding chamber and surrounded by an outer vacuum chamber to keep the oil warm as the vacuum serves as an insulator. This apparatus is also equipped with a dual voltage heater that can be used for warming the oil when the engine has set for long periods in cold weather. The unit is completely self contained an injects a blast of warm oil into the engine prior to starting. This reduces friction and wear to the engine. At the same time, this will reduce the load on the engine increasing efficiency at engine start-up and in turn reduce pollutants.

3 Claims, 2 Drawing Sheets

HEATED AND INSULATED PRE-LUBRICATION DEVICE FOR AN ENGINE

BACKGROUND OF THE INVENTION

The present invention relates to an apparatus for preoiling an internal combustion engine prior to starting, comprising a novel switching means, a storage chamber for holding warm oil located within a vacuum chamber and covered by an outer shell, and a release mechanism to force the oil into the engine prior to starting.

DESCRIPTION OF THE PRIOR ART

A major advantage relating to an internal combustion engine is the ability to preoil an engine prior to starting. This lessens the friction and wear on the internal parts of the engine. External oilers have been developed in countless numbers and require a pump. These systems do not allow for heating of the oil which is a disadvantage.

One system currently on the market disables the ignition system in the automobile and allows the engine to turn over until the oil pressure rises. The drawback in this system is wear and deterioration of the starter and battery.

SUMMARY OF THE INVENTION

It is an object of the invention to provide a preoiling apparatus which allows for the storage of oil under pressure in which a self contained switching mechanism is enclosed.

A further object of the invention is to provide a preoiling apparatus in which an oil storage chamber is insulated in a vacuum chamber to allow for injecting warm oil into an engine in which is contained a cold engine warming means for warming if the engine should set too long in cold weather.

Still another object of the invention is to provide a preoiling apparatus which is activated when the ignition switch is turned on prior to engaging the starter such that the device is self-contained and requires no pump to circulate the oil in the engine.

BRIEF DESCRIPTION OF THE DRAWINGS

The present invention will be more fully understood with reference to the following detailed description and the attached drawings.

DETAILED DESCRIPTION OF THE INVENTION

Figure 1:
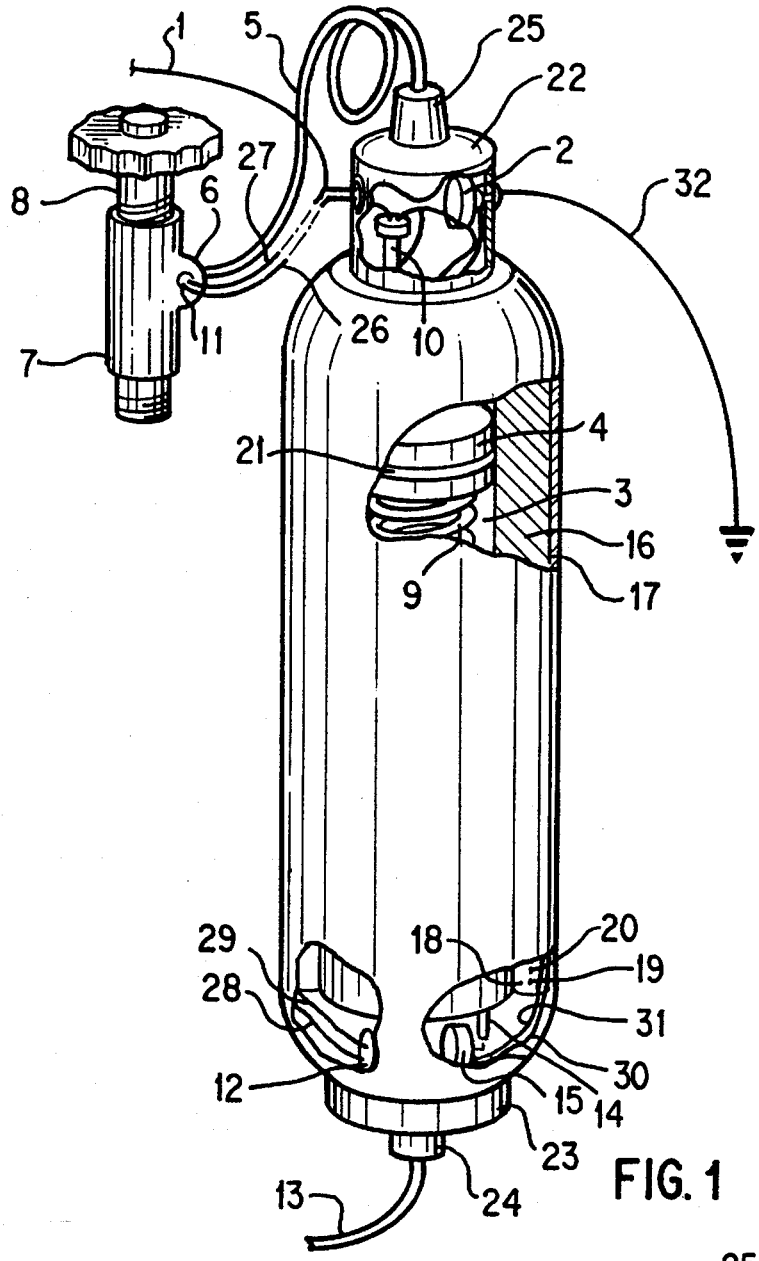
FIG. 1 is a sectional view of a preferred embodiment of this invention showing the preoiling apparatus of the present invention.
Figure 2:
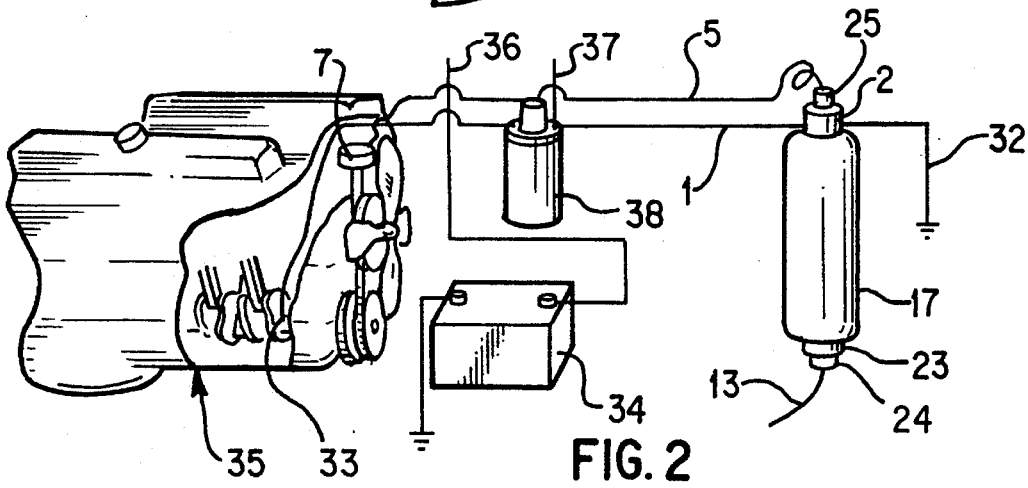
FIG. 2 is a view showing the preoiling apparatus of FIG. 1 as it would be connected to the engine.
Figure 3:
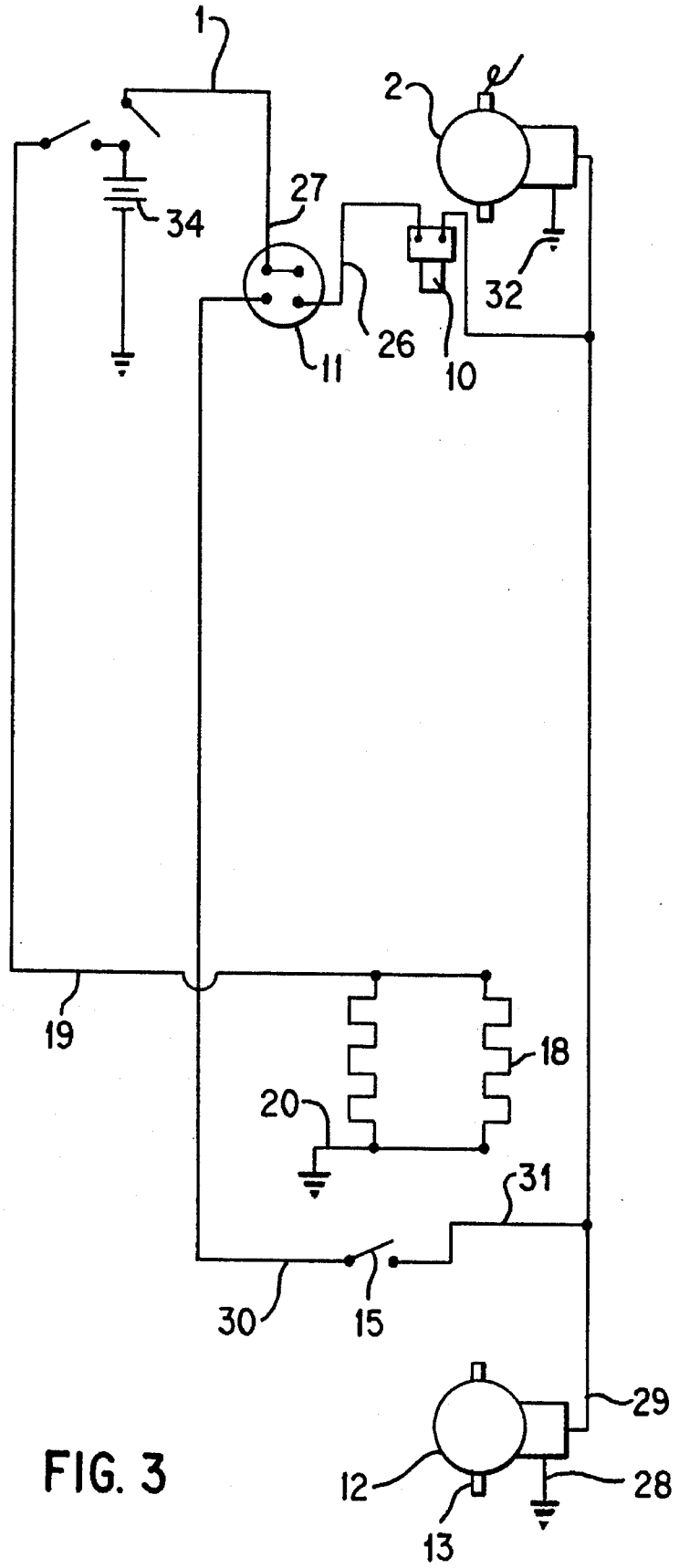
FIG. 3 is a view of the wiring diagram of the preoiling apparatus of FIG. 1.

The preoiling apparatus of this invention may be understood with reference to the figures. The apparatus comprises an inlet power line 1 for sending power to solenoid 2 which, when activated, opens a passage releasing warm oil held under pressure in holding chamber 3, by the force of a piston 4 through a flexible line 5, via seal 25 into an attached engine at port 6. Port 6 is part of a T-Block 7 which reroutes the sending unit 8 to create an opening for the oil from the preoiling apparatus into the engine. Piston 4, sealed by O-ring 21, is forced to push the off out of the chamber 3 by the force of a compressed spring 9. Once the piston has expelled all of the off, causing a pressure drop at sensor 10 located at the top of the device, the power to solenoid 2 is shut off, preventing cold oil from entering chamber 3. After the engine has reached operating temperature, a temperature sensing switch 11, set at a predetermined setting, is activated closing switch 11 and sending power to solenoids 2 and 12 through lines 26, 27, 28 and 29, allowing the hot engine oil to enter chamber 3. As the oil enters through solenoid 2, the fluid now forces against the top of the piston 4 causing the piston to move downward and in turn compressing the spring 9. During this cycle, vacuum from the engine enters through solenoid 12 from a flexible line 13 through seal 24, assisting the compression cycle. The higher pressure necessary to generate the discharge pressure for injection into the engine at 33, without the use of a pump, is achieved because the pressure of the fluid entering the top of the piston is multiplied by the area, in square inches, of the piston. Pressure times area in square inches equals force. When the piston reaches the bottom of the cylinder, it pushes down on the slide rod 14 activating switch 15 through lines 30 and 31, which turns off the power to solenoids 2 and 12. The hot fluid is now contained in chamber 3 and insulated by the surrounding vacuum chamber 16.

When power to solenoid 12 is turned off, it then bleeds off to the atmosphere and in turn releases the hold on the bottom of the piston. During this off cycle the power remains off. When the engine 35 is turned off the temperature drops, and the opposite set of contacts on switch 11 connect completing the circuit. Power from battery 34 through coil 38 can now be sent to the unit when the ignition switch is turned on, sending power to line 36 through line 37 and grounded at 32 completing one cycle of operation.

The complete apparatus of this invention is covered by an outer shell 17 and sealed with covers 22 and 23. If the unit is left in the cold for a long period of time a built in heater 18 can be turned on to warm the fluid connecting at leads 19 and 20 and may be of multiple voltages for convenience.

Although the preferred embodiment was explained using a spring or resilient member, one skilled in the art would recognize that the present invention is not limited to such use, but may be used with a piston solenoid combination or compressed gas or the like.

While this specification refers to specific devices, these references are not intended as limitations. Rather, the specification is intended to cover any substitutions, modifications, variations and additions such as, incorporating the apparatus of this invention into the oil filter itself, that would be apparent to one of ordinary skill in the art.

I claim:

1. A preoiling apparatus for an internal combustion engine enclosed in a one-piece shell, requiring no external pump, comprising:

(a) a self contained switching system which is activated by a temperature sensing switch which, when an attached engine has reached operating temperature, allows oil from the attached engine to flow into a fluid storage reservoir;

(b) a fluid storage reservoir, the volume of which is defined by a movable piston and the walls of said fluid storage reservoir, said piston being caused to move downward by the force of the fluid on the top of the piston, until said piston reaches the bottom of the storage reservoir, causing said temperature sensing switch to close, thereby preventing the pressurized oil from leaving the reservoir;

(c) a vacuum insulation chamber surrounding said fluid storage reservoir for the purpose of keeping fluid contained therein warm;

(d) a resilient member disposed below said piston to create a driving force sufficient to inject fluid from the fluid storage reservoir through a flexible line into an engine when activated by the ignition switch prior to engaging the engine's starter; and (e) an internal heater for heating oil in the fluid storage reservoir prior to operating the engine.

2. The preoiling apparatus of claim 1, comprising solenoid switches to open passageways and in thermal and mechanical communication with other switching means.

3. The preoiling apparatus of claim 1, comprising a piston and a resilient member that is activated by the engine oil pressure and multiplied by the area of the piston to create the necessary driving force, requiring no pump, and further comprising a vacuum assist switching means which uses engine vacuum to assist in pulling the piston downward when engine vacuum is connected to the fluid storage reservoir below said piston when said self contained switching system is activated by said temperature sensing switch.

* * * * *

UNITED STATES PATENT AND TRADEMARK OFFICE

CERTIFICATE OF CORRECTION

PATENT NO. : 5,460,097
DATED : October 24, 1995
INVENTOR(S) : Frank Nekola

It is certified that error appears in the above-indentified patent and that said Letters Patent is hereby corrected as shown below:

Column 2, line 1, "off" should read --oil--; line 3, "off" should read--oil--.

Signed and Sealed this

Twelfth Day of March, 1996

*Attest:*

BRUCE LEHMAN

*Attesting Officer*

*Commissioner of Patents and Trademarks*